US006149068A

United States Patent [19]

Molyneux

[11] Patent Number: 6,149,068

[45] Date of Patent: Nov. 21, 2000

[54] SUPPORT OF RESILIENT MATERIAL UNDER COMPRESSION ATTACHED TO A RAIL ANCHORAGE

[76] Inventor: Godfrey Matthew Owen Molyneux, 321 Squire Cir., Pittsburgh, Pa. 15108

[21] Appl. No.: 09/395,487

[22] Filed: Sep. 14, 1999

[51] Int. Cl.[7] ..... E01B 9/00

[52] U.S. Cl. ..... 238/310; 238/322; 238/317; 238/338; 238/349

[58] Field of Search ..... 238/310, 317, 238/315, 318, 321, 324, 338, 341, 349, 382

[56] References Cited

U.S. PATENT DOCUMENTS

| | | | |
|---|---|---|---|
| 3,923,245 | 12/1975 | Marchant | 238/347 |
| 4,026,466 | 5/1977 | Duchemin | 238/349 |
| 4,821,957 | 4/1989 | Molyneux | 238/317 |
| 4,988,040 | 1/1991 | Keusch | 238/349 |

*Primary Examiner*—S. Joseph Morano
*Assistant Examiner*—Frantz Jules

[57] ABSTRACT

This invention relates to rail anchorages that are used with all rails, but is particularly concerned with adjustable rail anchorages, which allow rail alignment to be adjusted, and which are installed on rails used by cranes. To reduce this rail movement and to help limit vertical uplift of the rail, pressure is applied to the rail flange by resilient material attached to the part of the rail anchorage that overhangs the rail flange. The object of this invention is to provide support to the resilient material in a way that its length can be increased from the bonded surface or outside of the pocket in which it is installed. The invention allows for a greater variation in rail size and rail elevation that can be accommodated with one rail anchorage type and differing lengths of the resilient material. Please refer to FIG. 12 in the accompanying drawings.

9 Claims, 13 Drawing Sheets

SUPPORT OF RESILIENT MATERIAL UNDER COMPRESSION ATTACHED TO A RAIL ANCHORAGE

This invention relates to rail anchorages that are used with all rails, but is particularly concerned with adjustable rail anchorages, which allow rail alignment to be adjusted, and which are installed on rails used by cranes. As the crane travels along the rails, starting and stopping, they shunt the rails backwards and forwards along the length of the rail. Also, the rails are not perfectly flat, and may be twisted, which causes a rocking movement of the rails as the crane travels along their length. Similarly the rail support may be uneven and twisted which will also cause the rails to rock. To reduce this rail movement and to help limit vertical uplift of the rail, pressure is applied to the rail flange by resilient material attached to the part of the rail anchorage that overhangs the rail flange.

PRIOR ART

Reference may be made to my prior U.S. Pat. No. 4,821,957. In the prior art resilient material has been vulcanized or bonded to the underside of the part of the rail anchorage that overhangs the rail flange. Alternatively the resilient material is placed in a pocket. This resilient material is limited in total length, i.e. in the vertical plain above the rail flange, by its unsupported length from the pocket or the surface to which to it is bonded. If the increase in length of the resilient material is too great it produces a relatively slender section in relation to its total length, which is prone to buckling when compressed. Consequently to fit widely differing thicknesses of rail flanges, or if the rails are supported on a steel or resilient strip, which greatly increases their elevation, the part of the anchorage that overhangs the rail flange has also to be adjusted in elevation. In this way several types of rail anchorages are required because of the limited range in elevation that can be accommodated by the limitation of length of the resilient material.

OBJECT OF THE INVENTION

If a longer strip of resilient material protrudes from a pocket in the rail anchorage or from a bonded surface several problems can occur. The resilient material can buckle so that it will not provide effective compression to the rail flange. This may also allow the resilient material to escape from the pocket or tear from the bonded surface. The object of this invention is to provide support to the resilient material in a way that its length can be increased from the bonded surface or outside of the pocket. A greater variation in rail size and rail elevation can then be accommodated with one rail anchorage type and differing lengths of the resilient material.

DESCRIPTION OF THE DRAWINGS

The invention will be better understood from the following detailed description in conjunction with the accompanying drawings:

FIG. 1 is a rail;

FIG. 2 is a rail flange;

FIG. 3 is a block of resilient material;

FIG. 4 is a housing in the form of an enclosure or pocket which receives a block of resilient material;

FIG. 5 is the front part of the anchorage that abuts the rail;

FIG. 6 is a support surface for the rail and the rail anchorage;

FIG. 7 is a screw threaded stud or bolt attached to the support surface. This can be any stationary element in relation to the support surface by which the rail anchorage is installed;

FIG. 8 is a threaded nut;

FIG. 9 is a washer;

FIG. 10 is a rotatable cam that has an eccentric hole which receives the welded stud or bolt 7;

FIG. 11 is an adjustable rail anchorage with a large round aperture to receive a rotatable eccentric cam. When the cam is rotated within the aperture, the anchorage moves relative to the rail and relative to the stud or bolt. There is a similar adjustable rail anchorage on the opposing side of the rail so that the alignment of the lateral position of the rail can be adjusted. The invention can be used with non-adjustable rail anchorages but is particularly suited to adjustable rail anchorages since these can be installed tightly against the rail flange. This restricts lateral rail movement, which if allowed can tear and also dislodge the resilient material from the rail anchorage.

FIG. 14 is a surface on the rail anchorage to which the resilient material is bonded.

FIG. 15 is a circular aperture in the rail anchorage that receives a rotatable cam.

FIG. 1 is a side view of an adjustable rail anchorage 11 with a pocket 4 housing resilient material 3 which is compressed on a rail flange 2. This is prior art. FIG. 2 is also a side view of the prior art as FIG. 1 but illustrates when a rail supported on a steel wear strip or resilient strip 12 is increased in elevation, the pocket 4 on the rail anchorage 11 needs to be higher up the anchorage to adjust to the new rail elevation. FIG. 3 is a plan view of the prior art. The eccentric position of the stud or bolt 7 can be seen within the cam 10. When the cam is rotated within aperture 15 of the rail anchorage 11 and about the stationary bolt 7, this moves the rail anchorage laterally in relation to the rail. FIG. 4 is a side view of the rail anchorage with a pocket 4 high up on the rail anchorage 11. The resilient material 3 has been lengthened to suit a lower rail elevation. The idea of the invention is to allow this longer length of resilient material 3 to compress evenly on to the rail flange 2 and remain stable. However, as FIGS. 5 and 6 illustrate this resilient material can easily buckle and prevent the proper compression force being applied to the rail flange 2. Under these circumstances the resilient material may not be sufficiently compressed into the pocket. If the resilient material 3 buckles it can also become dislodged from the pocket 4 particularly if the resilient material 3 is not strongly bonded into the pocket 4 and requires compression to maintain it within the pocket. FIG. 7 shows that in cases where the front of the rail anchorage 5 is not accurately placed against the rail flange any small repeated sideways movement of the rail, represented by the arrows shown below the rail, will also destabilize the resilient material 3. In FIG. 8 the resilient material 3 has been shaped so that it is supported by the front of the rail anchorage 5 below the level of the pocket 4 and above the rail flange 2. This stabilizes the material against buckling in the direction towards the rail anchorage and away from the rail. The front of the pocket 4 has an extension 13 which is downwards towards the rail flange. This extension can be for just part or all of the length of the front of the pocket, that is in the direction along the length of the rail. This extension 13 stabilizes the resilient material in the direction away from the rail anchorage. In FIG. 9 the pocket 4 for the resilient material has been moved so that the rear of the pocket is more closely aligned to the front part of the rail anchorage 5 that abuts the rail. This allows for a more efficiently shaped resilient material section which can be supported along its rear side by an extension of the rail anchorage's surface 5 that abuts the rail. In FIG. 10 where the rail elevation is increased by the insertion of a wearing strip or resilient material under the rail 12 or where a larger rail is installed, the front pocket extension 13 has been ground off to make sufficient space for the rail. Because the length of the resilient material has been significantly reduced the front support extension 13 from the pocket is no longer required. Under other situations, the front pocket extension 13 may need to be reduced in length by grinding , if circumstances warrant support of the resilient material and also if greater clearance is required between the rail flange and extension 13. FIG. 11 shows that with resilient material bonded to the rail anchorage, and not positioned within a pocket, how the invention will also support longer lengths of the resilient material. FIG. 12 illustrates a pocket in the rail anchorage that is wedged shaped. This allows the resilient material to be forced up and be wedged within the pocket. The supporting surfaces that contact the resilient material also slope to form a wedging action. As the compression force on the resilient material from the rail flange is increased this forces the resilient material against the sides, which because of the wedging action, increases the support offered by those surfaces contacting the resilient material. Because the material compresses and conforms to the surrounding surfaces, it does not have to be correspondingly wedge shaped in its pre-compressed state. FIG. 13 is a plan view of FIG. 9. The relationship between the rear of the pocket and the front of the rail anchorage 5 can be seen.

What is claimed is:

1. A rail anchorage comprising: a housing, a resilient member fixed secured to the housing and having a portion extending outside the housing for bearing down on a flange of a rail that the rail anchorage is to secure, and a rigid extension member having a portion extending outside the housing and substantially along the portion of the resilient member which extends outside the housing, said rigid extension member abutting against and supporting the portion of the resilient member extending outside the housing when the resilient member bears down on the flange of the rail so that the resilient member continually provides an effective and evenly compressive force to the flange during relative movement between the rail anchorage and the rail regardless of the length of the resilient member which extends outside the housing.

2. A rail anchorage of claim 1 wherein the housing is formed with a pocket for receiving the resilient member and wherein the rigid extension member is located adjacent to the pocket and extends substantially the length of the pocket in the housing.

Figure 13:
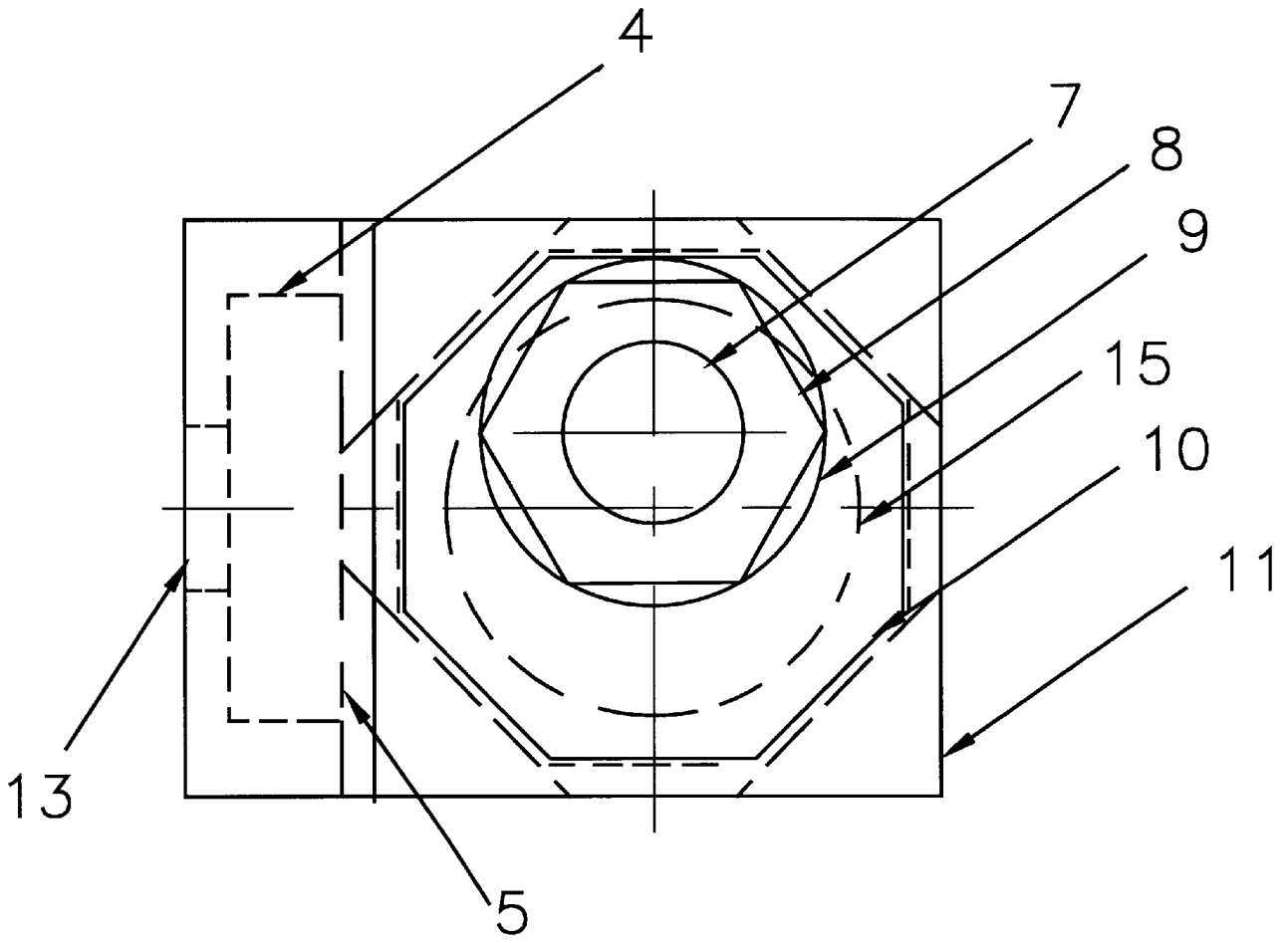
FIG. 13 is an extension of the front part of the pocket downwards towards the rail flange.

3. A rail anchorage of claim 1 wherein the housing is formed with a pocket for receiving the resilient member and wherein the rigid extension member is located adjacent to the pocket and extends a partial length of the pocket in the housing. (FIG. 13)

Figure 1:
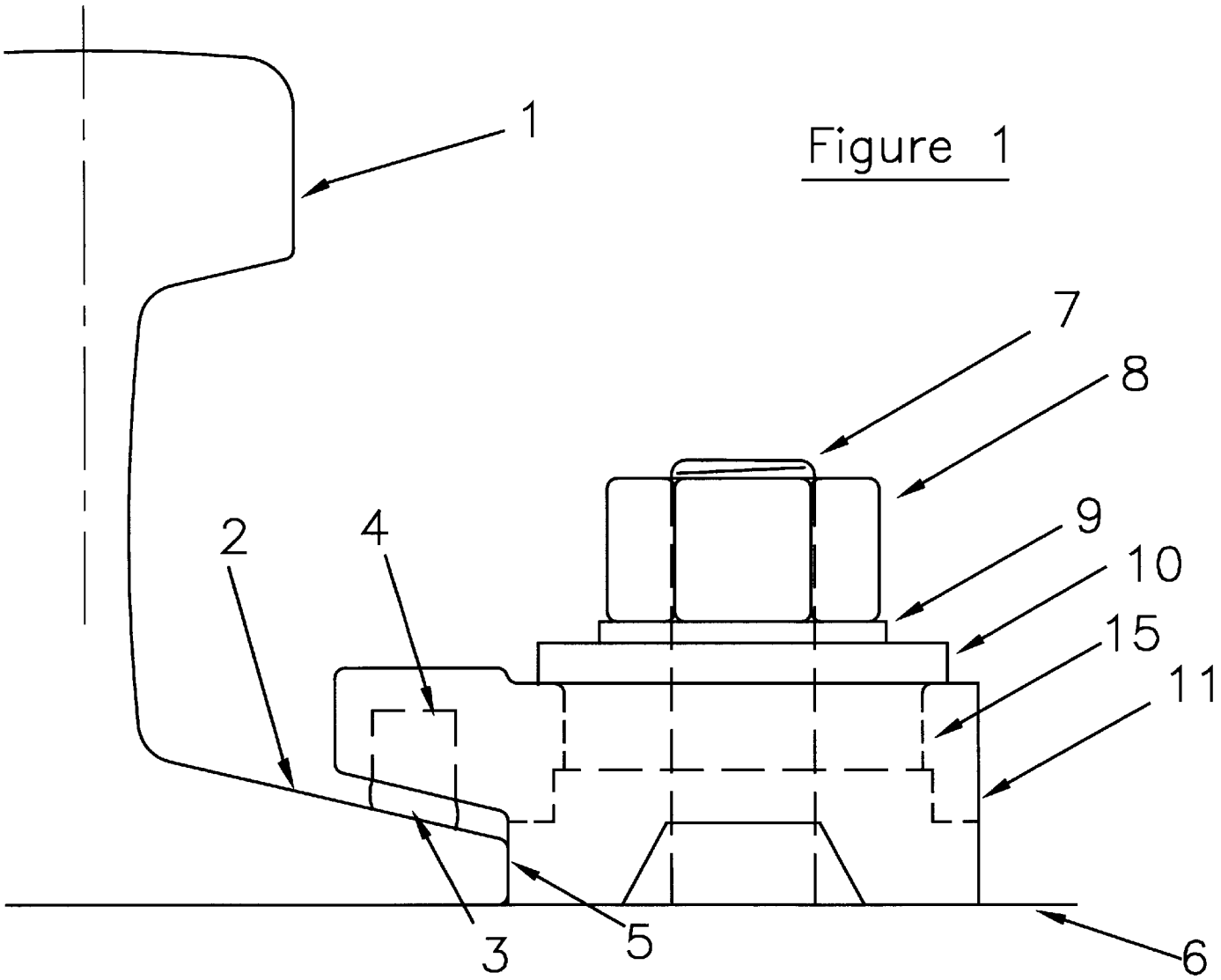
In FIGS. 1 to 11.
Figure 2:
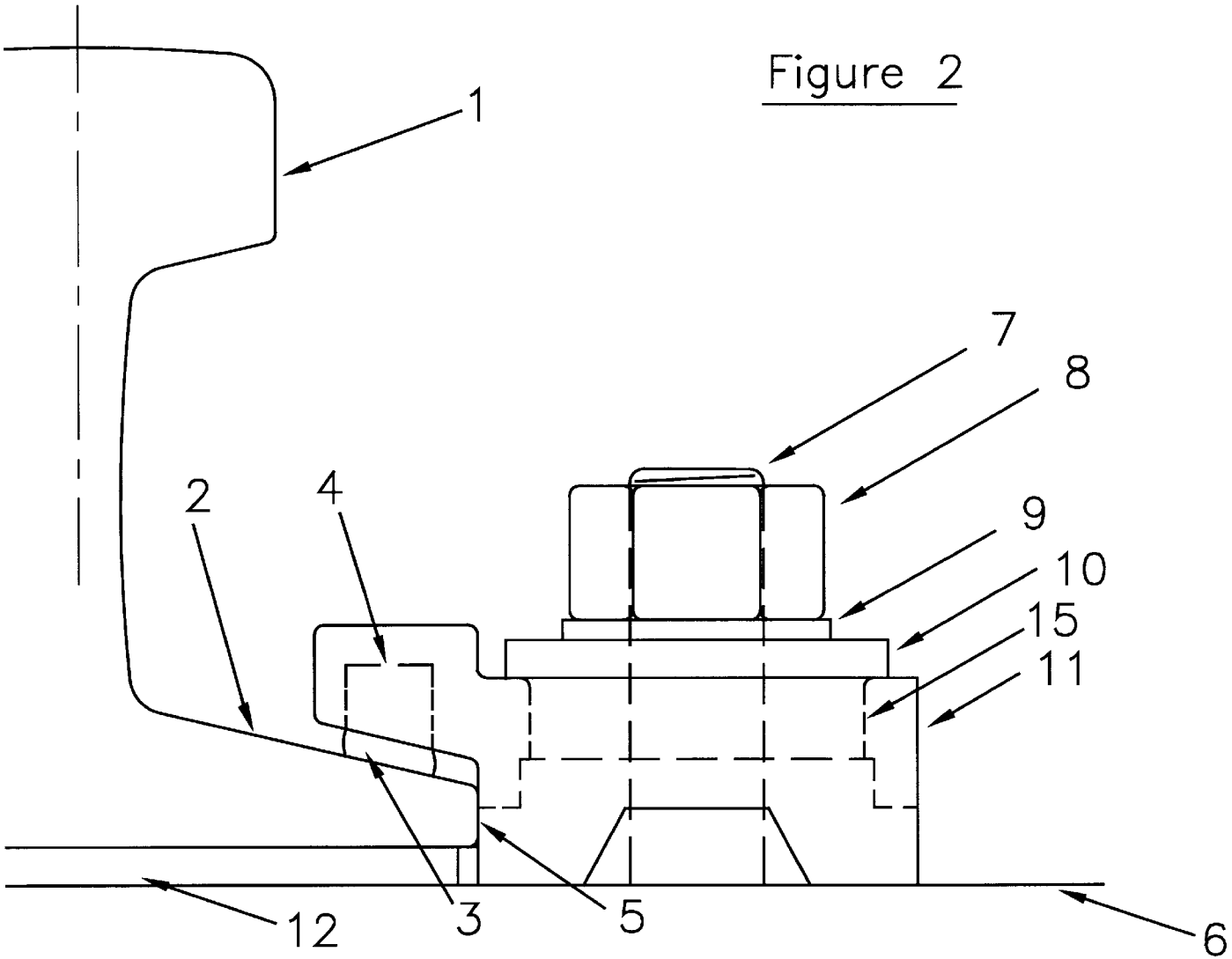
Figure 3:
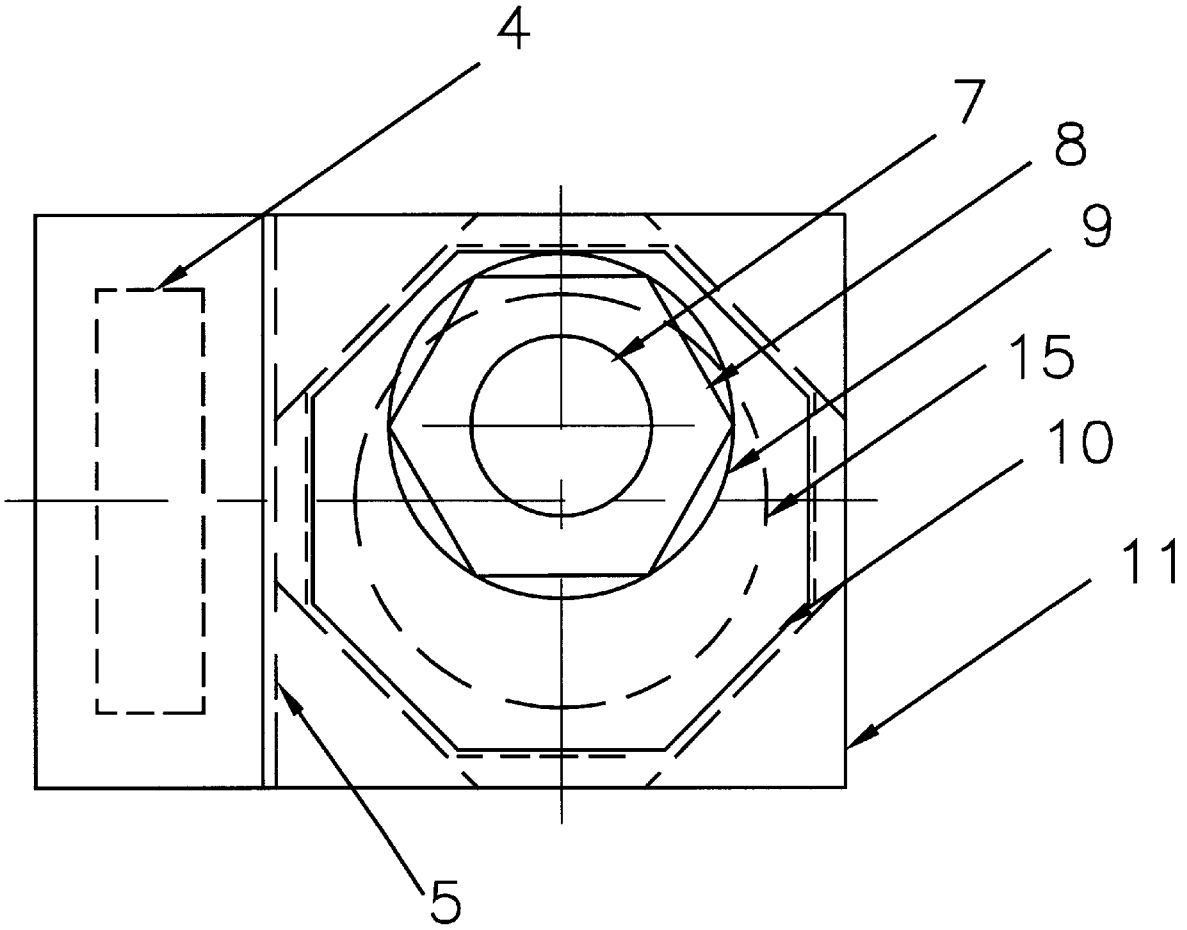
Figure 4:
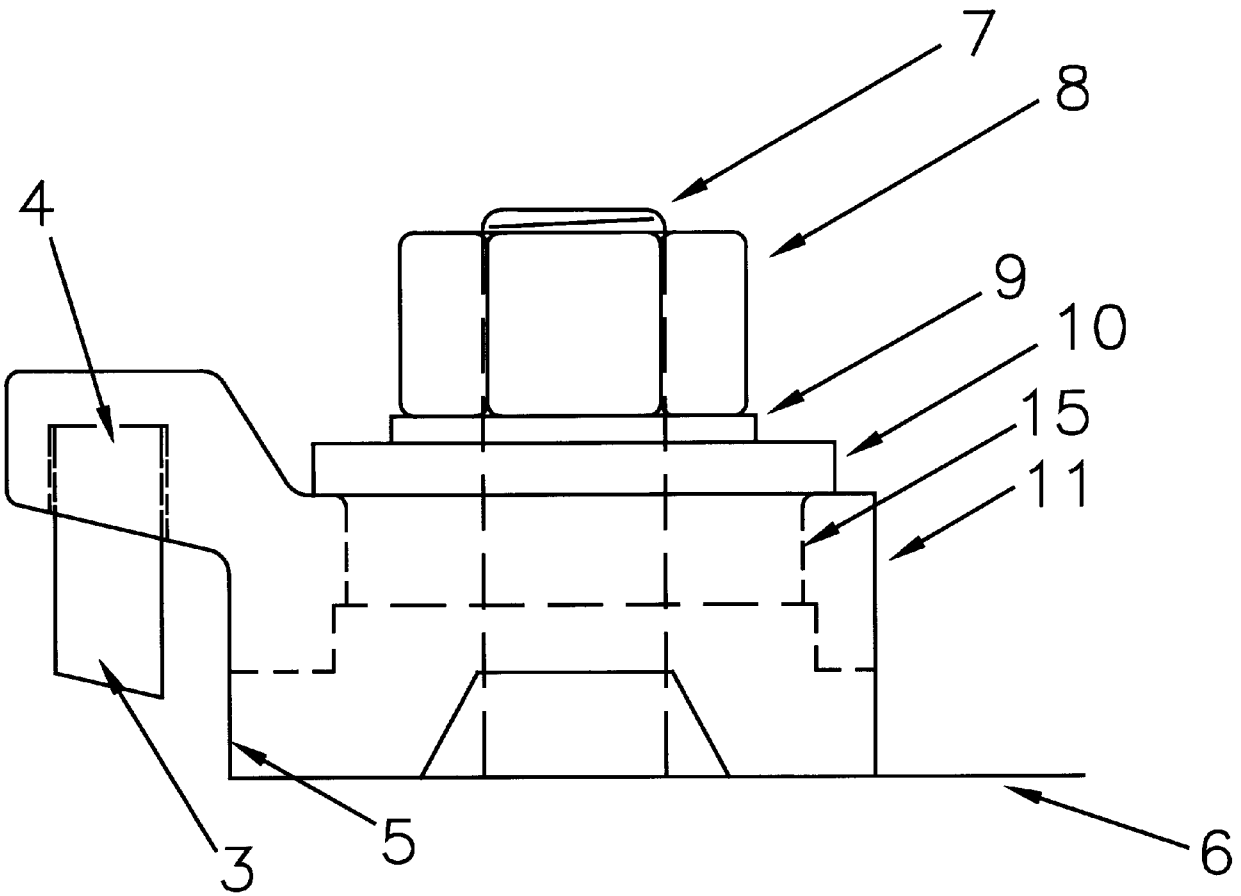
Figure 5:
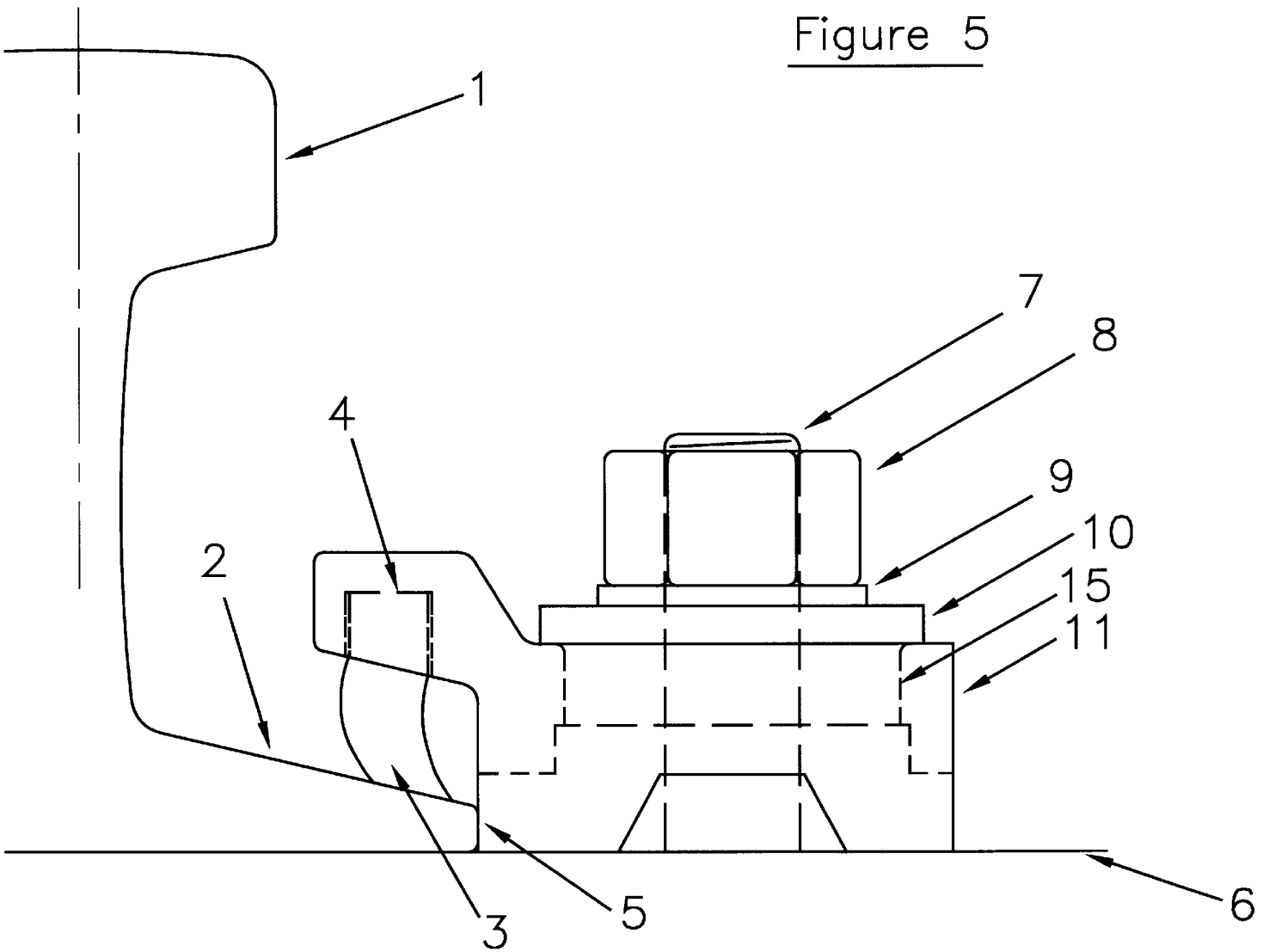
Figure 6:
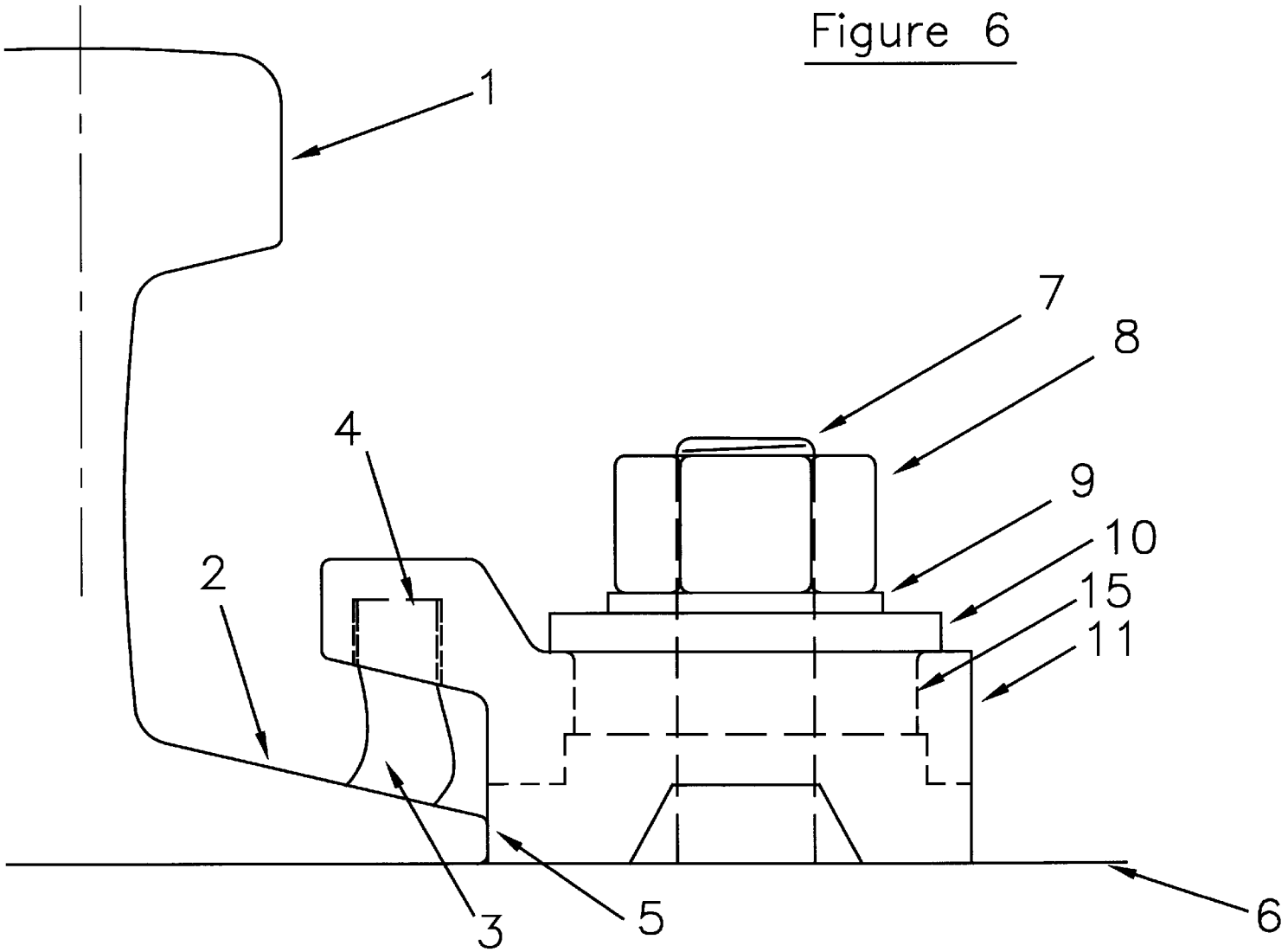
Figure 7:
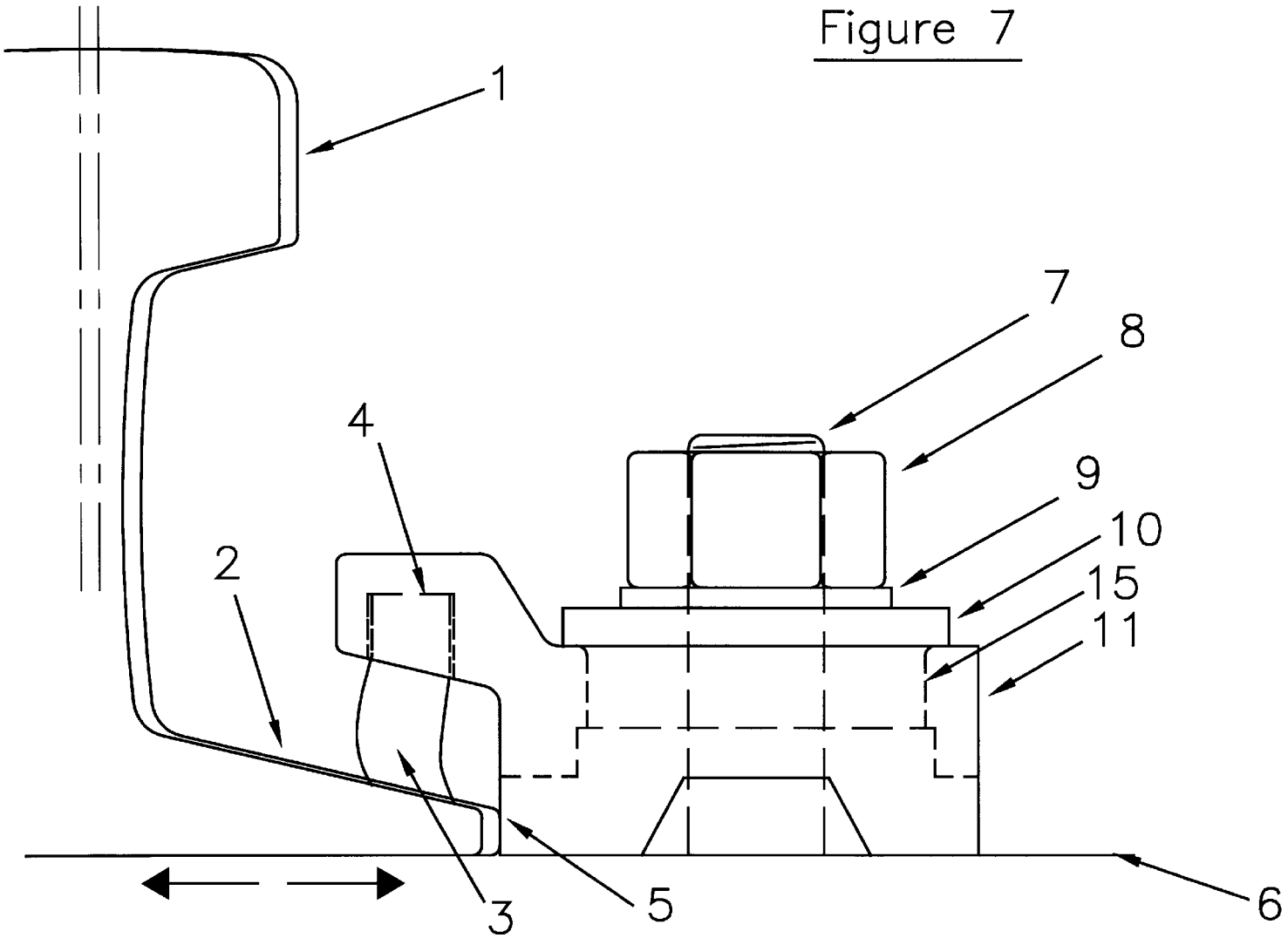
Figure 8:
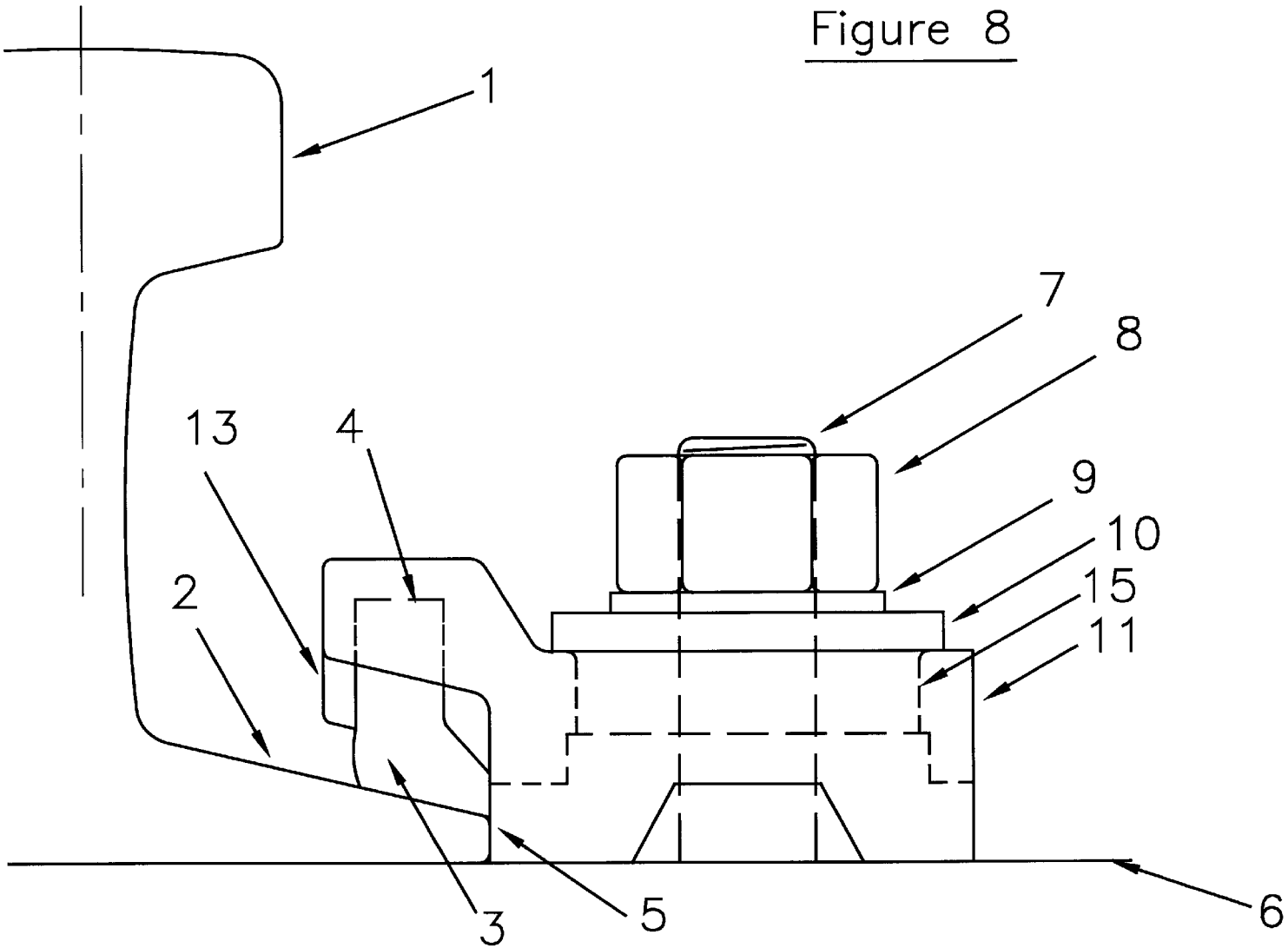

4. A rail anchorage of claim 1 further comprising a main body portion for supporting the housing and wherein the housing is formed with a pocket for receiving the resilient member, and wherein the pocket is sp aced outwardly in the housing away from the main body portion of the rail anchorage so as to locate the resilient member outwardly from the main body portion of the rail anchorage and up on the flange of the rail when the rail anchorage is assembled on the rail. (FIG. 8).

5. A rail anchorage of claim 4 wherein the resilient member is shaped to have an extended leg portion which abuts against the main body portion of the rail anchorage. (FIG. 8)

Figure 9:
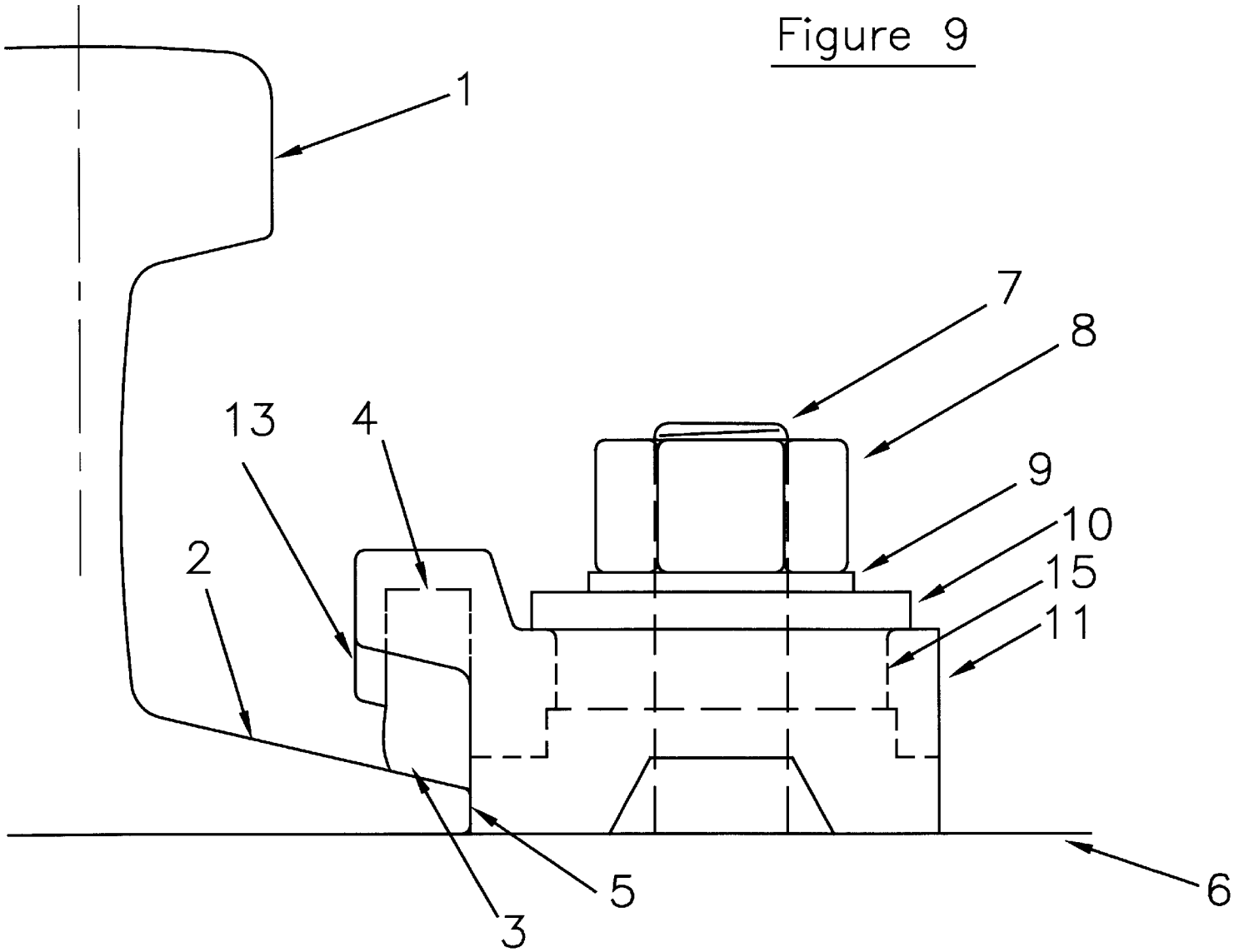
Figure 10:
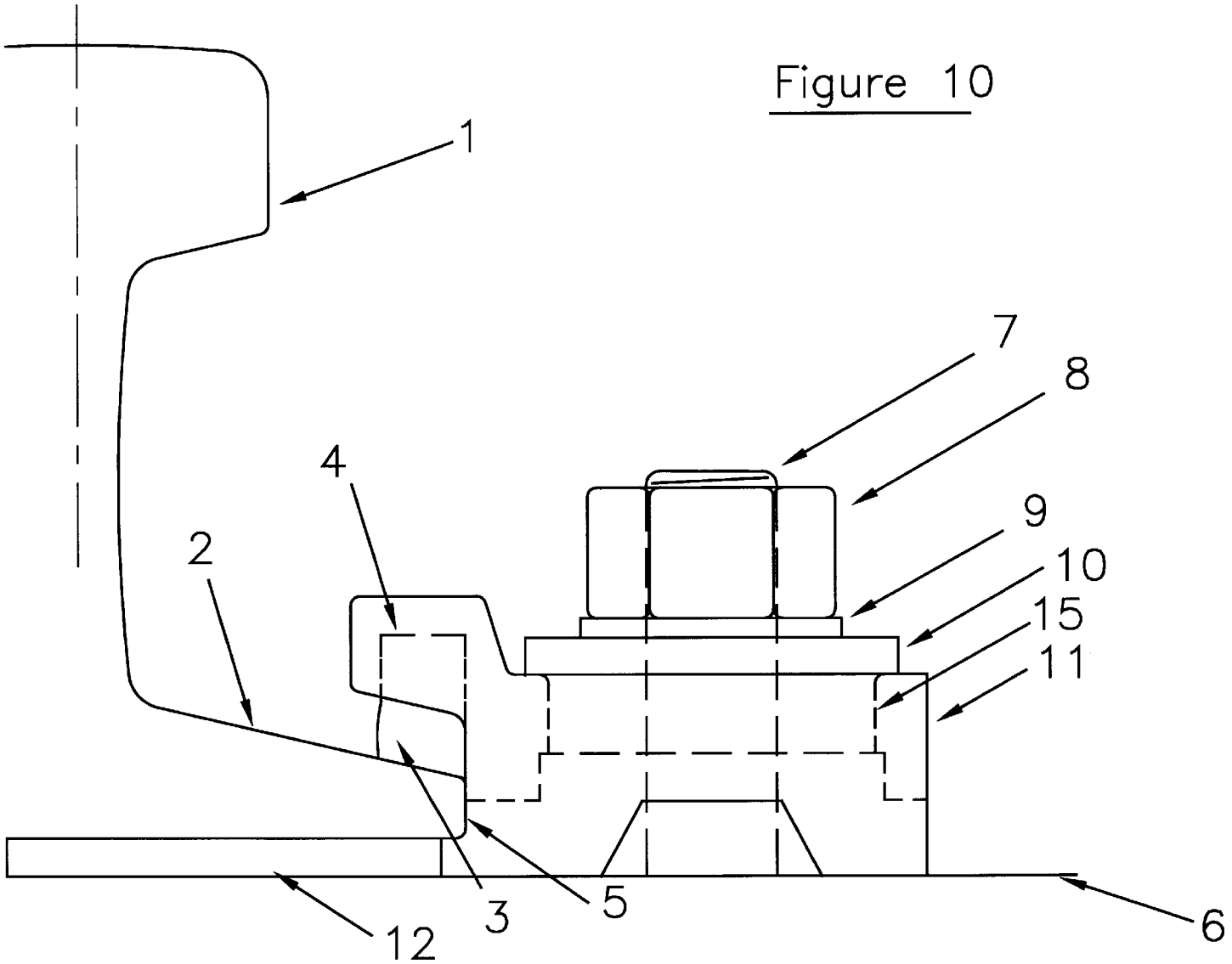
Figure 11:
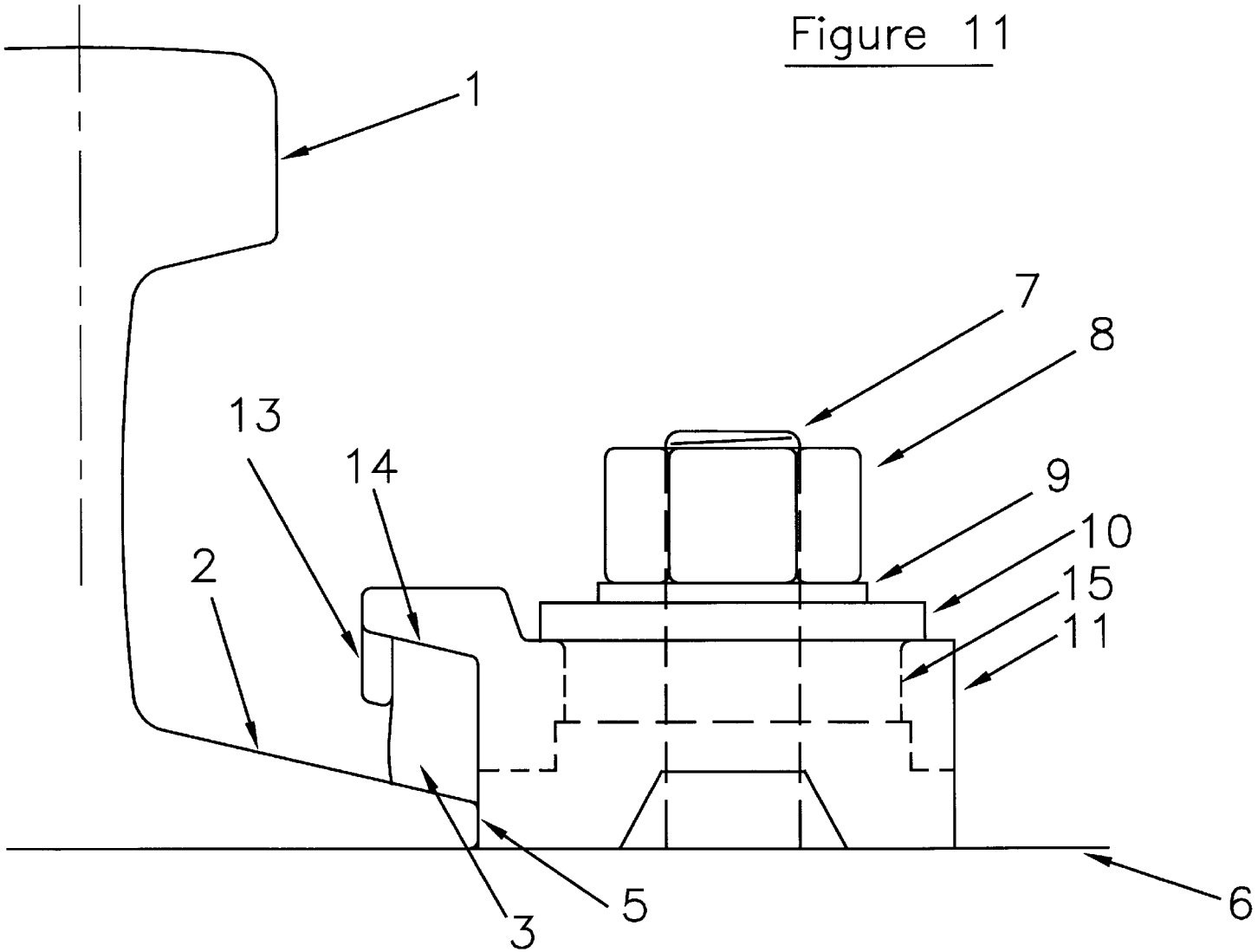

6. A rail anchorage of claim 1 further comprising a main body portion for supporting the housing and wherein the housing is formed with a pocket for receiving the resilient member and wherein the pocket is closely located in the housing toward the main body portion of the rail anchorage so as to locate the resilient member near the main body portion and down on the flange of the rail when the rail anchorage is assembled on the rail. (FIGS. 9 and 10)

7. A rail anchorage of claim 1 wherein the housing is formed with a pocket for receiving the resilient member and wherein the rigid extension member is located adjacent to the pocket.

Figure 12:
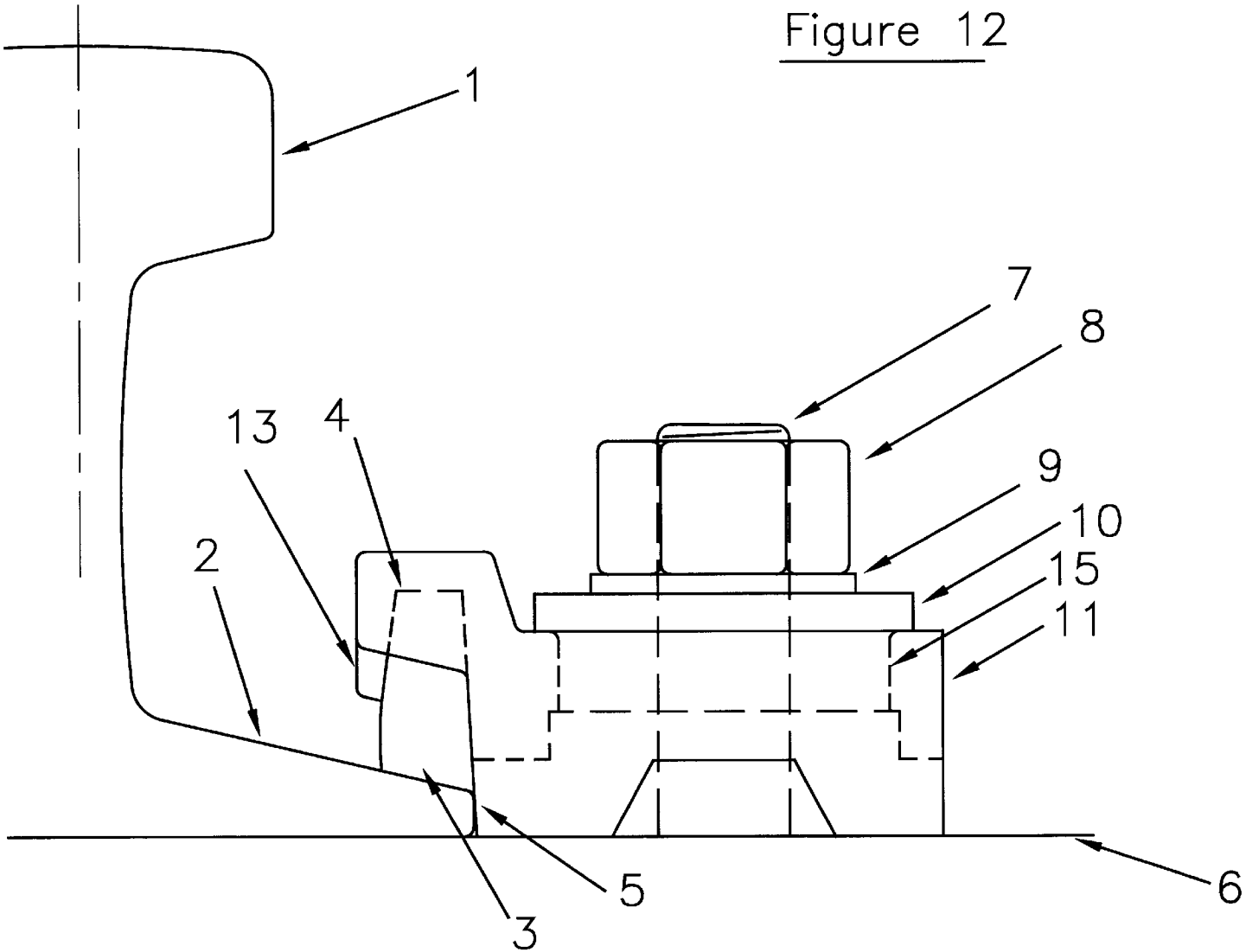
FIG. 12 is a steel wearing strip or resilient strip beneath the rail.

8. A rail anchorage of claim 7 wherein the pocket has wedged shaped side walls along its length so that the resilient member is wedged within the pocket and wherein the rigid extension member has a wedge shaped side wall which cooperates with the wedge shaped side walls of the pocket to provide a wedging action against the resilient member whereby as the compressive force on the resilient member from the rail flange is increased the resilient member is forced against the wedge shaped side walls of the pocket and the wedged shaped side wall of the extension member thereby increasing the support of the surfaces of the wedged shaped side walls of the pocket and the wedged shaped side wall of the extension member against the resilient member. (FIG. 12).

9. A rail anchorage of claim 8 wherein the resilient member has a wedged shaped surface corresponding to and abutting against the wedged shaped side walls of the pocket and the wedged shaped side wall of the extension member for creating a wedging action of the resilient member in the housing when a compressive force is applied to the resilient member by the flange of the rail.

* * * * *